US005327755A

United States Patent [19]

Thompson

[11] Patent Number: 5,327,755

[45] Date of Patent: Jul. 12, 1994

[54] CONSTANT FLOW CONTROL FOR A PRESSURE POT SHOT PEENING MACHINE

[75] Inventor: Robert A. Thompson, Quaker Street, N.Y.

[73] Assignee: General Electric Company, Schenectady, N.Y.

[21] Appl. No.: 930,957

[22] Filed: Aug. 17, 1992

[51] Int. Cl.[5] ..... B24C 7/00

[52] U.S. Cl. ..... 72/53; 29/90.7; 51/320

[58] Field of Search ..... 72/53; 29/90.7; 51/319; 137/606, 897

[56] References Cited

U.S. PATENT DOCUMENTS

| | | | |
|---|---|---|---|
| 4,230,147 | 10/1980 | Booth et al. | 137/606 |
| 4,420,957 | 12/1983 | Weber | 72/53 |
| 4,614,100 | 9/1986 | Green et al. | 72/53 |
| 4,873,855 | 10/1989 | Thompson | 72/53 |

*Primary Examiner*—David Jones

*Attorney, Agent, or Firm*—James R. McDaniel; Paul R. Webb, II

[57] ABSTRACT

This invention relates to a constant flow control device for a pressure pot shot peening machine. Such structures of this type, generally, assure that the air flow and the pressure drop through the pressure pot shot peening nozzle remain independent of uncontrolable upstream conditions, thus assuring constant velocity of the shot stream regardless of shot delivery hose routing or wear.

3 Claims, 2 Drawing Sheets

CONSTANT FLOW CONTROL FOR A PRESSURE POT SHOT PEENING MACHINE

BACKGROUND OF THE INVENTION

1. Field of the Invention

This invention relates to a constant flow control device for a pressure pot shot peening machine. Such structures of this type, generally, assure that the air flow and the pressure drop through the pressure pot shot peening nozzle remain independent of uncontrolable upstream conditions, thus assuring constant velocity of the shot stream regardless of shot delivery hose routing or wear.

2. Description of the Related Art

A key control difficulty inherent in conventional pressure pot shot peening machines involves maintaining constant conditions of the shot stream with a remote system of control. That is, pressure pot shot machines are normally set up and controlled as shown in FIG. 1. A constant pressure supply of air is mixed with shot well upstream of the shot peening nozzle. The shot mass flow rate of the stream is controlled by flow through a fixed orifice or by a closed loop mass flow controller such as a magnetic flow controller built by Electronics, Inc. To assure shot flow stability, a bleed line (see FIG. 1) maintains a constant pressure across the shot flow controller.

The need for a remote system of control is directed by requirements of machine motion and flexibility and the hostile environment of the shot peening cabinet itself. Thus, the cabinet containing various control functions described above must be well removed from the shot delivery nozzle. The shot delivery hose, usually about 20 feet long, is therefore needed to connect the cabinet to the nozzle. The air velocity in the hose must be sufficient to sweep the shot along with it to the nozzle where the two phase flow is accelerated and ejected from the nozzle at a velocity sufficient to perform the peening operation.

The problem with pressure pot systems is that there is a sizable pressure drop in the delivery hose, as well as, the nozzle itself due to the shot/air stream. Thus, the pressure available in the throat of the nozzle where the shot is accelerated to its terminal velocity is well below the pressure control set point. Worst yet, the pressure drop is not constant. It depends upon the routing of the hose, hose wear, nozzle geometry, and the mass flow rate of the shot. There is no better illustration of this fact than the well known observation that the peening intensity increases for otherwise fixed conditions when the hose wears, because the reduced flow resistance makes more pressure available at the nozzle. Therefore, a more advantageous system, then, would be presented if the air flow and the pressure drop through the nozzle remained independent of uncontrolable upstream conditions.

It is apparent from the above that there exists a need in the art for a pressure pot shot peening machine which is capable of delivering shot to the workpiece, and which at least equals the shot peening characteristics of the known shot peening machines, but which at the same time is capable of assuring that the air flow and the pressure drop through the nozzle remains independent of uncontrollable upstream conditions. It is a purpose of this invention to fulfill this and other needs in the art in a manner more apparent to the skilled artisan once given the following disclosure.

SUMMARY OF THE INVENTION

Generally speaking, this invention fulfills these needs by providing a constant flow control device for a pressure pot shot peening system comprising an air supply means, an air mass flow controller means operatively connected to said air supply means, a pressure pot means operatively connected to said air mass flow controller means, and a nozzle means operatively connected to said pressure pot means.

In certain preferred embodiments, the air supply means includes a manual gate valve. Also, the air mass flow controller means includes a choked nozzle flow control. Also, the pressure pot means includes a shot mass flow control. Finally, the air and shot are mixed near the pressure pot and are ejected out of a nozzle.

In another further preferred embodiment, the constant flow control device avoids the problems inherent in conventional pressure control machines by assuring that the air flow and, thus, the pressure drop through the nozzle remains independent of uncontrolable upstream conditions, thus, assuring constant velocity of the shot stream regardless of shot delivery, hose routing or wear.

The preferred constant flow control device, according to this invention, offers the following advantages: ease of assembly; constant flow control; good stability; good durability; good economy; constant velocity of the shot stream; constant pressure drop through the nozzle; and high strength for safety. In fact, in many of the preferred embodiments, these factors of constant flow control, constant shot stream velocity and constant pressure drop are optimized to an extent that is considerably higher than heretofore achieved in prior, known flow controls for pressure pot shot peening machines.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several veins and in which.

DETAILED DESCRIPTION OF THE INVENTION

Figure 1:
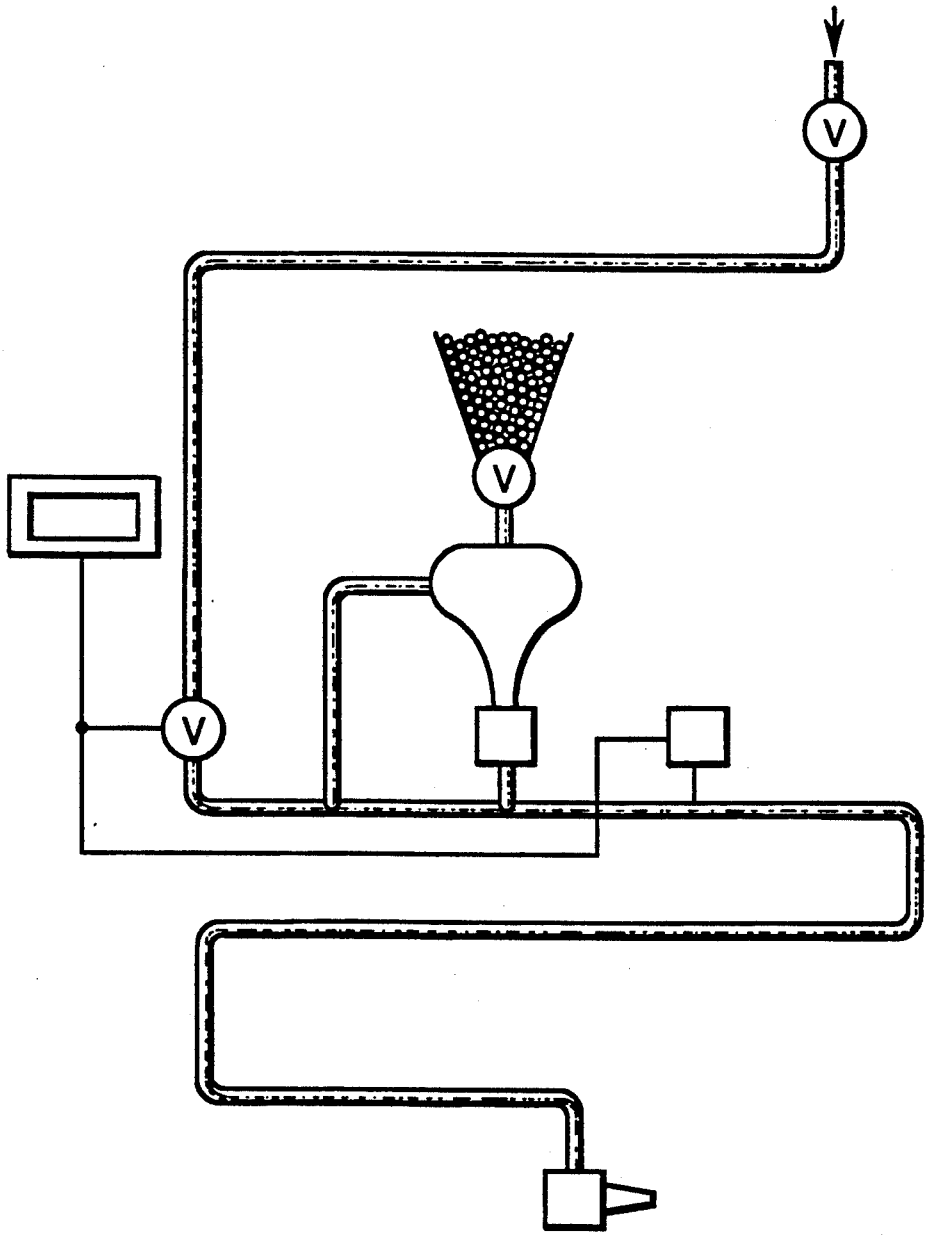
fig. 1 (PRIOR ART)
FIG. 1 is a schematic illustration of a conventional pressure pot shot peening machine, according to the prior art.

As discussed earlier, FIG. 1 is a schematic illustration of a conventional pressure pot shot peening machine.

Figure 2:
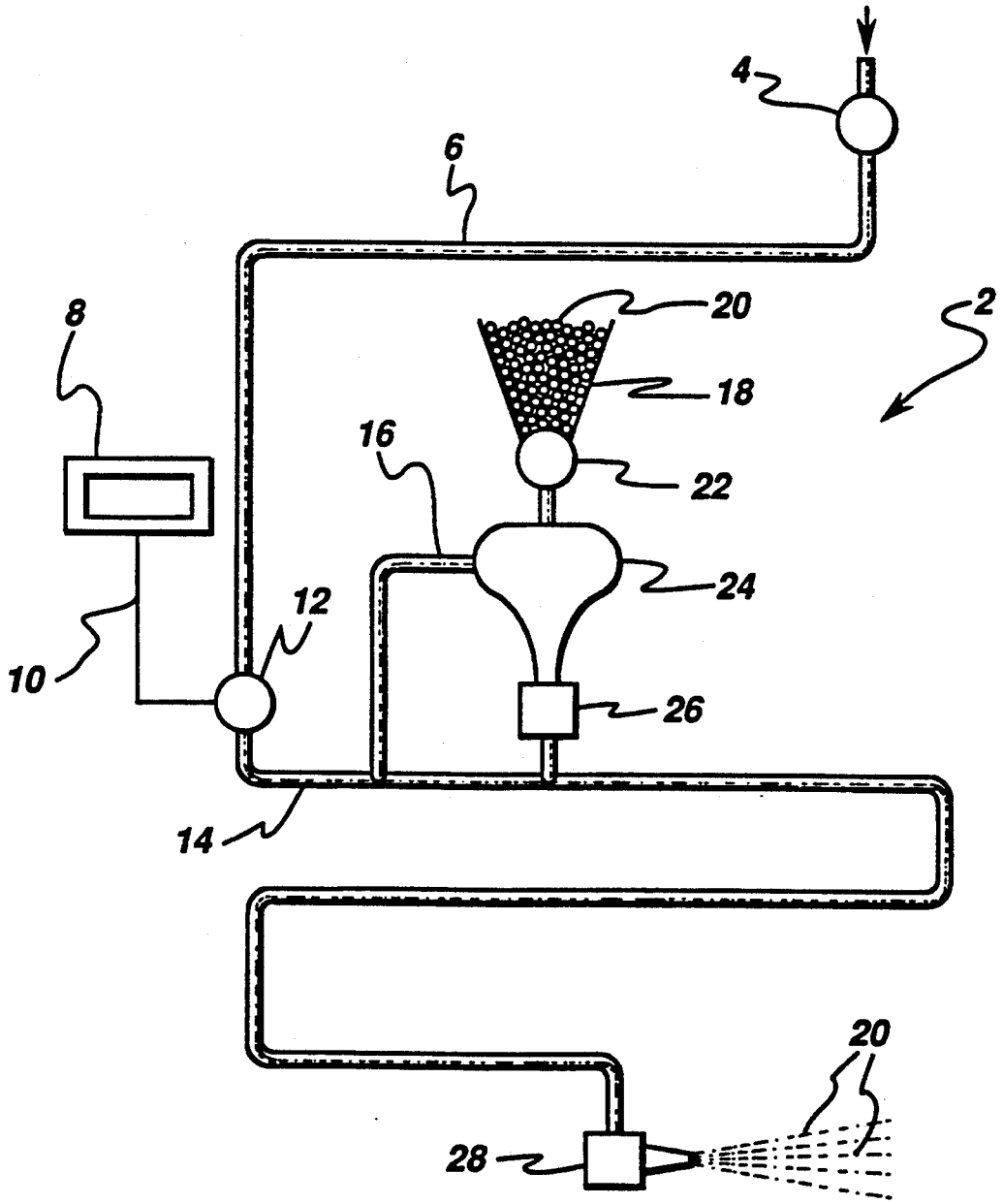
FIG. 2 is a schematic illustration of a constant flow control for a pressure pot shot peening machine, according to the present invention.

With reference to FIG. 2, there is illustrated constant flow control device 2 for a pressure pot shot peening system. Device 2 includes, in part, valve 4, hoses 6 and 14, flow indicator 8, lead 10, air mass flow controller 12, bleed line 16, shot hopper 18, shot 20, valve 22, pressure pot 24, mass flow controller 26, and nozzle 28. In particular, valve 4, preferably, is a conventional manual gate valve. Flow indicator 8, preferably, is a conventional digital flow indicator. Air mass flow controller 12, preferably, is a conventional chocked nozzle flow control.

Mass flow controller 26, preferably, is a conventional magnetic densitometer.

It is to be understood that while air mass flow controller 12, preferably, is a choked nozzle flow control, other such air mass flow controllers can be used. For example, other air mass flow controllers may be an orifice flow controller or a thermal flow controller.

During the operation of device 2, air is introduced through valve 4 along hose 6, past air mass flow controller 12 to pressure pot 24 along hose 14. At that time shot is introduced from pressure pot 24 through shot mass flow controller 26 into hose 14. In a flow controlled system, the pounds per minute flow of air is fixed (barring leakage) through the system 2 and the pressures throughout the system 2 adjust themselves to maintain the flow. Now, regardless of the flow resistance, the conditions in the throat of nozzle 28 remain fixed for a fixed mass flow of shot 20 and the system 2 operates independent of such things as hose wear or routing. Pressure bleed line 16 should assure a constant pressure on the inlet and outlet of the shot mass flow controller 26.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A constant flow control device for a pressure pot shot peening system, wherein said device is comprised of:

an air supply means;

an air mass flow controller means operatively connected to said air supply means wherein said air mass flow controller means is further comprised of a choked nozzle flow control;

a pressure pot means operatively connected to said air mass flow controller means; and a nozzle means operatively connected to said pressure pot means.

2. The device, as in claim 1, wherein said air supply means is further comprised of:

a valve means.

3. A method for constantly controlling the flow of shot and air from a pressure pot shot peening system including an air supply means, an air mass flow controller means, a pressure pot means, a shot mass flow controller means, a conduit means, and a nozzle means, wherein said method is comprised of the steps of:

operating said air supply means;

introducing air into said conduit means;

measuring and recording an amount of air in said conduit means;

operating said pressure pot means;

introducing shot into said conduit means from said pressure port means;

measuring and recording an amount of shot in said conduit means;

ejecting said air and shot from said nozzle means;

comparing said amounts of air and shot with a predetermined amount of air and shot; and adjusting, if necessary, said air supply means.

* * * * *